US009350082B2

(12) United States Patent
Huang et al.

(10) Patent No.: US 9,350,082 B2
(45) Date of Patent: May 24, 2016

(54) DUAL-BAND MONOPOLE COUPLING ANTENNA

(71) Applicant: ARCADYAN TECHNOLOGY CORPORATION, Hsinchu (TW)

(72) Inventors: Chih-Yung Huang, Taichung County (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 267 days.

(21) Appl. No.: 14/186,229

(22) Filed: Feb. 21, 2014

(65) Prior Publication Data

US 2015/0084815 A1 Mar. 26, 2015

(30) Foreign Application Priority Data

Sep. 24, 2013 (TW) ..... 102134312 A

(51) Int. Cl.

| | |
|---|---|
| ***H01Q 1/38*** | (2006.01) |
| ***H01Q 9/42*** | (2006.01) |
| ***H01Q 5/378*** | (2015.01) |
| ***H01Q 5/00*** | (2015.01) |

(52) U.S. Cl.

CPC ..... *H01Q 9/42* (2013.01); *H01Q 5/0027* (2013.01); *H01Q 5/378* (2015.01); *H01Q 1/38* (2013.01)

(58) Field of Classification Search

CPC ..... H01Q 9/42; H01Q 5/378; H01Q 5/0027; H01Q 1/38

USPC ..... 343/700 MS, 745, 793

See application file for complete search history.

(56) References Cited

U.S. PATENT DOCUMENTS

2009/0135087 A1* 5/2009 Gummalla ..... H01P 3/02 343/909

2012/0127050 A1* 5/2012 Song ..... H01Q 1/1271 343/756

OTHER PUBLICATIONS

ARRL, The ARRL Antenna Book, ARRL, p. 2-24.*

* cited by examiner

*Primary Examiner* — Sue A Purvis
*Assistant Examiner* — Jae Kim
(74) *Attorney, Agent, or Firm* — WPAT, PC; Justin King; Jonathan Chiang

(57) ABSTRACT

A dual-band monopole coupling antenna is disclosed, which comprises: a first radiation part, configured with a frame and an extension section while being disposed on a surface of a substrate; a second radiation part, disposed on the surface of the substrate at a position neighboring to the first radiation part for enabling a coupling effect between the two, allowing the second radiation part to be used as an extension of the first radiation part, and thus adjusting the operation frequency, impedance and impedance matching accordingly; a signal ground section, disposed coupling to the second radiation part; a signal feed-in section, disposed on the surface at a position neighboring to the signal ground section while coupling to the first radiation part; a ground, disposed coupling to the second radiation part; and a dielectric layer, disposed at an non-conductive area arranged between the first radiation part and the second radiation part.

5 Claims, 11 Drawing Sheets

DUAL-BAND MONOPOLE COUPLING ANTENNA

FIELD OF THE INVENTION

The present invention relates to a dual-band monopole coupling antenna, and more particularly, to a combined monopole with couple-type dual-band printed antenna that is designed with adjustable frequency band for adapting the same to operate under various working environments and also is substantially a printed antenna to be formed directly on a circuitboard for minimizing the molding cost as well as the production cost of three-dimensional antennas.

BACKGROUND OF THE INVENTION

In the modern era of rapidly developing technology, it is essential to have various types of antennas that not only can be adapted for various electronic communication devices available today while ensuring good signal transceiving efficiency, but also are small enough to be embedded in modern handheld or portable electronic devices for wireless communication. For instance, there are antennas designed for cellular phones, notebook computers, or external wireless transmission devices, such as access points (APs) and card buses. Generally, there are two types of antennas, i.e. the planar inverse-F antenna (PIFA) and monopole antenna, that are already been used commonly in the modern handheld electronic devices since they are advantageous in their simplicity in structure and good transmission performance. Taking the PIFA from the aforesaid conventional antennas for instance, for enabling signal from an electronic device to be transmitted out through a PIFA that is electronically connected to the electronic device through a coaxial cable, the electric connection between the two is generally achieved by connecting the inner conductive layer and the outer conductive layer respectively to the signal feed-in point and the ground point of the PIFA. Moreover, although the monopole antenna is a well-developed and ancient antenna, it is still being commonly used in modern handheld electronic devices. Consequently, the present invention combines the advantages of the aforesaid two types of antennas so as to suggest a combined monopole with couple-type dual-band printed antenna that can be adapted for various wireless communication devices.

The combined monopole with couple-type dual-band printed antenna suggested in the present invention is an antenna that can be adjusted and modified easily for meeting any specified requirement of different wireless communication devices. For instance, it can be adapted to operate in the following different frequency bands, including: LTE-Band 1 (1920~2170 MHz), LTE-Band 3 (1710~1880 MHz), LTE-Band 4 (1710~21455 MHz), 3G-Band (860~1000 MHz), LTE-Band 40 (2300~2400 MHz), LTE-Band 20 (791~862 MHz), UMTS (1920~2170 MHz), and thus the combined monopole with couple-type dual-band printed antenna of the present invention can be used in wireless communication devices operating in the aforesaid frequency bands, such as notebook computers, access points (APs), TV with Wi-Fi capability and DVD with Wi-Fi capability, and so on. In addition, the antenna suggested in the present invention can be used in all wireless communication devices of LTE 1805 MHz~2170 MHz, or can be used as frequency adjusting antenna for other wide-band radio communication devices.

Nevertheless, it is noted that the bandwidth of PIFA is generally narrow, and antennas adapted for wide-band applications can be very complex in structure that it is difficult to be fine-tuned for adapting the same to different environments.

Thus, the antenna suggested in the present invention is a cost-effective antenna that can be shared by multiple devices without having its operating frequency band to be adjusted.

SUMMARY OF THE INVENTION

In view of the disadvantages of prior art, the primary object of the present invention is to provide a dual-band monopole coupling antenna, and more particularly, to provide a combined monopole with couple-type dual-band printed antenna that is designed with adjustable frequency band for adapting the same to operate under various working environments and also is substantially a printed antenna to be formed directly on a circuitboard for minimizing the molding cost as well as the production cost of three-dimensional antennas. Moreover, the combined monopole with couple-type dual-band printed antenna suggested in the present invention is an antenna that can be adjusted and modified easily for meeting any specified requirement of different wireless communication devices.

To achieve the above object, the present invention provides a dual-band monopole coupling antenna, which comprises: a first radiation part, being disposed on a surface of a substrate; a second radiation part, disposed on the surface of the substrate at a position neighboring to the first radiation part for enabling a coupling effect between the second radiation part and the first radiation part so as to allow the second radiation part to be used as an extension of the first radiation part, and thus for enabling the overall operation frequency, impedance and impedance matching of the dual-band monopole coupling antenna to be adjusted accordingly; a signal ground section, disposed on the surface of the substrate while having an end thereof to connect to the second radiation part and another end thereof to connect to a signal feed-in line; a signal feed-in section, disposed on the surface of the substrate at a position neighboring to the signal ground section while coupling to the first radiation part; a ground, disposed on the surface of the substrate while coupling to the second radiation part; and a dielectric layer, disposed at an non-conductive area; wherein, the first radiation part is designed to operate at a first frequency, while the second radiation part is designed to operate at a second frequency.

In an embodiment of the invention, the first radiation part further comprises: a frame and a primary extension, in which the frame is designed to be adjustable in length for enabling the operation frequency of the antenna to be adjusted accordingly; and the primary extension is formed as a tapering section that is extending from the rear of the frame and is connected to the frame by the narrow end thereof while allowing the signal feed-in section to be disposed at the wide end thereof, and thus the primary extension is used for increasing bandwidth.

In an embodiment of the invention, the second radiation part is disposed neighboring to the first radiation part by a side thereof, while enabling the second radiation to extend in opposite directions on the side thereof next to the first radiation part, i.e. a first direction and a second direction, whereas the first direction is orientated the same as the extending of the primary extension of the first radiation part, and the second direction is orientated the same as the extending of the frame of the first radiation part.

In an embodiment of the invention, the second radiation part further comprises a first extension and a second extension, in which the first extension is connected to the second radiation part by a portion thereof in the first direction and is extending in a length for adapting the antenna to operate at the second frequency while allowing the signal ground section to be disposed neighboring to an end of the first radiation part;

and the second extension is extending in a length for allowing the second frequency to be adjusted according to the length and is configured with two ends while enabling one of the two ends to connect to the first extension and another end to extend in the second direction, and thereby, enabling the second radiation part, the first extension, and a portion of the second extension to be disposed neighboring to the primary extension of the first radiation part.

In an embodiment of the invention, the second radiation part further comprises a third extension and a fourth extension, in which the third extension is connected to of the second radiation part by a portion thereof in the second direction; and the fourth extension is configured with two ends while enabling one of the two ends to connect to the third extension and another end to extend in the first direction, and thereby, enabling the second radiation part, the third extension, and a portion of the fourth extension to be disposed neighboring to the frame of the first radiation part while allowing the impedance matching of the antenna to be adjusted according to the gap formed between the second extension and the fourth extension.

In an embodiment of the invention, the third extension further has a fifth extension, attached to a side of the third extension that is connected to the fourth extension and neighboring to the frame of the first radiation, and consequently, the impedance matching of the antenna is enabled to be adjusted according to the size of the fifth extension.

In an embodiment of the invention, the ground is a component selected from the group consisting of: an independent ground and a non-independent ground.

In an embodiment of the invention, the dielectric layer is disposed at an non-conductive area arranged surrounding the first radiation part and the second radiation part.

In an embodiment of the invention, the first frequency is higher than the second frequency.

Consequently, the dual-band monopole coupling antenna of the invention has the following advantages:

(1) It is a combined monopole with couple-type dual-band printed antenna whose operating frequency band can be adjusted easily for adapting the same to various applications.

(2) It is a dual-band antenna combined monopole with couple-type antennas.

(3) It is an antenna can be formed smaller than the common planar inverse-F antenna since it can be designed without addition ground as the common planar inverse-F antenna did.

(4) The antenna of the present invention is enabled to operated in a signal feed-in manner via a 50Ω transmission cable that is coupled directly to the signal feed-in point of the antenna, whereas another end of the 50Ω transmission cable can extend at will to a RF signal module.

(5) The antenna of the present invention is enabled to operated in a signal feed-in manner via a 50Ω resistor that is coupled directly to the circuitboard, by that the cost of using a cable for signal feed-in can be waived, and also the cost required for producing molds of three-dimensional antenna parts and for assembling the same can be waived.

(6) The antenna of the present invention can be formed and operate independently on a PCB, or can advantageously and selectively work with various communication devices, as the antenna of the invention is designed with independent adjusting mechanism for allowing the same to be adapted for different applications in different communication devices.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein:

FIG. 1, being composed of FIG. 1A and FIG. 1B.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figures 1A, 1B:
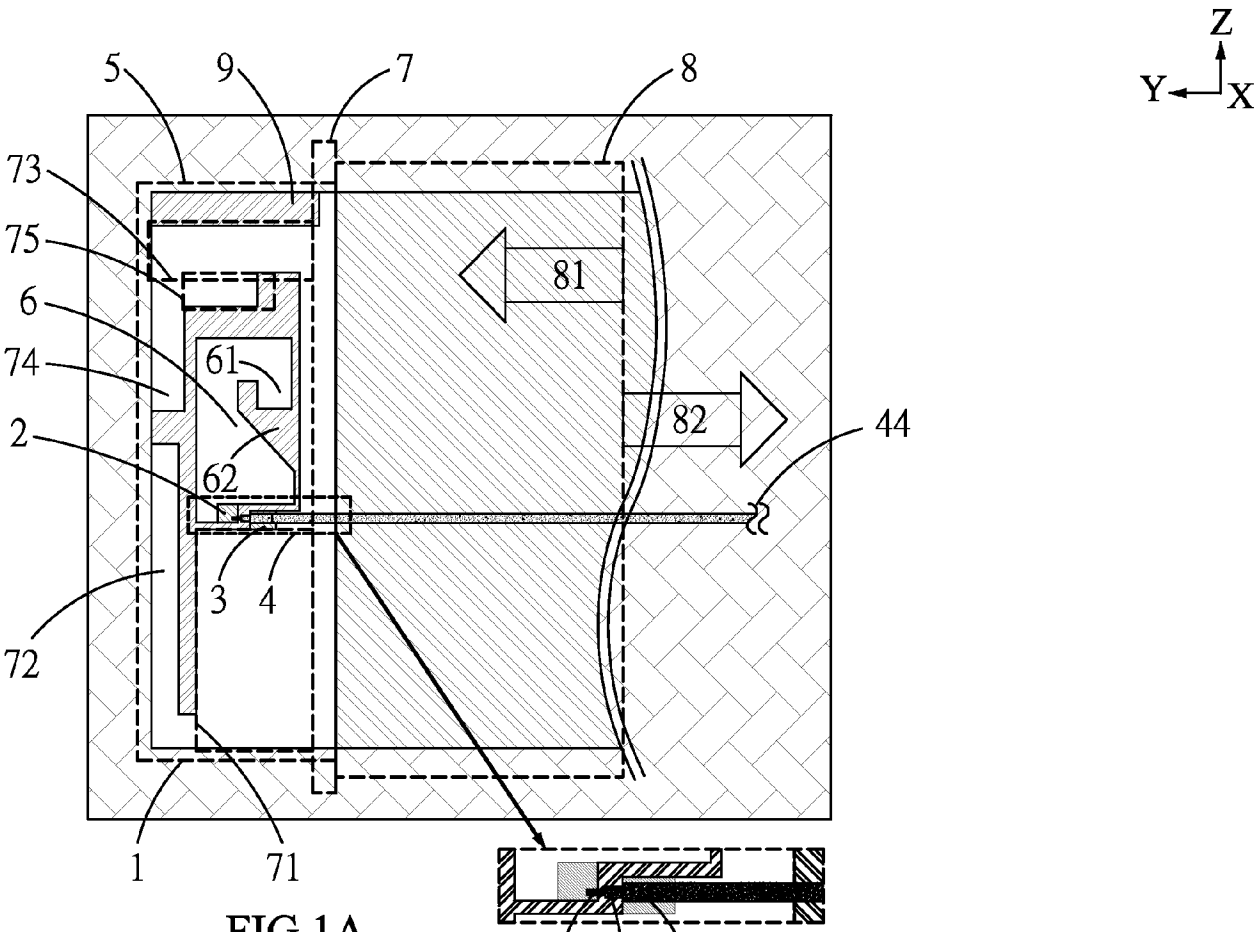
FIG. 1A is a schematic diagram showing a dual-band monopole coupling antenna of the present invention and FIG. 1B is an enlarged view of a signal feed-in section of FIG. 1A.

Please refer to FIG. 1A and FIG. 1B, which are respectively a schematic diagram showing a dual-band monopole coupling antenna of the present invention and an enlarged view of a signal feed-in section of FIG. 1A. As shown in FIG. 1A and FIG. 1B, a dual-band monopole coupling antenna of the invention comprises: a first radiation part 6, being disposed on a surface of a substrate; a second radiation part 7, disposed on the surface of the substrate at a position neighboring to the first radiation part 6 for enabling a coupling effect between the second radiation part 7 and the first radiation part 6 so as to allow the second radiation part 7 to be used as an extension of the first radiation part 6, and thus for enabling the overall operation frequency, impedance and impedance matching of the dual-band monopole coupling antenna to be adjusted accordingly; a signal ground section 3, disposed on the surface of the substrate while enabling an end thereof to couple to the second radiation part 7 and another end thereof to couple to a signal feed-in line 4; a signal feed-in section 2, disposed on the surface of the substrate at a position neighboring to the signal ground section 3 while coupling to the first radiation part 6; a ground 8, disposed on the surface of the substrate while coupling to the second radiation part 7; and a dielectric layer 9, disposed at an non-conductive area surrounding the first radiation part 6 and the second radiation part 7; wherein, the first radiation part 6 is designed to operate at a first frequency, while the second radiation part 7 is designed to operate at a second frequency, and the first frequency is higher than the second frequency.

Except for the ground 8, all the other components mentioned above are disposed inside a frame 5 of the antenna. In addition, the first radiation part 7 further comprises: a frame 61 and a primary extension 62, in which the frame 61 is designed to be adjustable in length for enabling the operation frequency of the antenna to be adjusted accordingly; and the primary extension 62 is formed as a tapering section that is extending from the rear of the frame 61 and connected to the frame 61 by the narrow end thereof while allowing the signal feed-in section 2 to be disposed at the wide end thereof.

The second radiation part 7 is disposed neighboring to the first radiation part 6 by a side thereof, while enabling the second radiation 7 to extend in opposite directions on the side thereof next to the first radiation part 6, i.e. a first direction and a second direction, whereas the first direction is orientated the same as the extending of the primary extension 62 of the first radiation part 6, and the second direction is orientated the same as the extending of the frame 61 of the first radiation part 6.

Moreover, the second radiation part 7 further comprises a first extension 71 and a second extension 72, in which the first extension 71 is connected to the second radiation part 7 by a portion thereof in the first direction and is extending in a length for adapting the antenna to operate at the second frequency while allowing the signal ground section 3 to be disposed at an end of the first extension 71 that is disposed neighboring to the first radiation part 6; and the second extension 72 is extending in a length for allowing the second frequency to be adjusted according to the length and is configured with two ends while enabling one of the two ends to connect to the first extension 71 and another end to extend in the second direction, and thereby, enabling the second radiation part 7, the first extension 71, and a portion of the second extension 72 to be disposed neighboring to the primary extension 62 of the first radiation part 6.

In this embodiment, the second radiation part 7 further comprises a third extension 73 and a fourth extension 74, in which the third extension 73 is connected to of the second 74 radiation part 7 by a portion thereof in the second direction; and the fourth extension is configured with two ends while enabling one of the two ends to connect to the third extension 73 and another end to extend in the first direction, and thereby, enabling the second radiation part 7, the third extension 73, and a portion of the fourth extension 74 to be disposed neighboring to the frame 61 of the first radiation part 6 while allowing the impedance matching of the antenna 1 to be adjusted according to the gap formed between the second extension 72 and the fourth extension 74.

In addition, the third extension 73 further comprises: a fifth extension 75, attached to a side of the third extension 73 that is connected to the fourth extension 74 and neighboring to the frame 61 of the first radiation 6, and consequently, the impedance matching of the antenna 1 is enabled to be adjusted according to the size of the fifth extension 75.

The abovementioned a signal feed-in line 4 is further configured with a center signal line 41, a ground end 42, an isolation layer 43, a signal feed-in point 44 in a manner that the center signal line 41 is connected to the signal feed-in section 2, the ground end 42 is connected to the signal ground section 3, the isolation layer 43 is disposed for isolating the center signal line 41 from the ground end 42, and the signal feed-in point 44 is disposed at the signal input/output of a RF circuit for enabling the RF circuit to connected to the dual-band monopole coupling antenna via the signal feed-in line 4.

Figure 2:
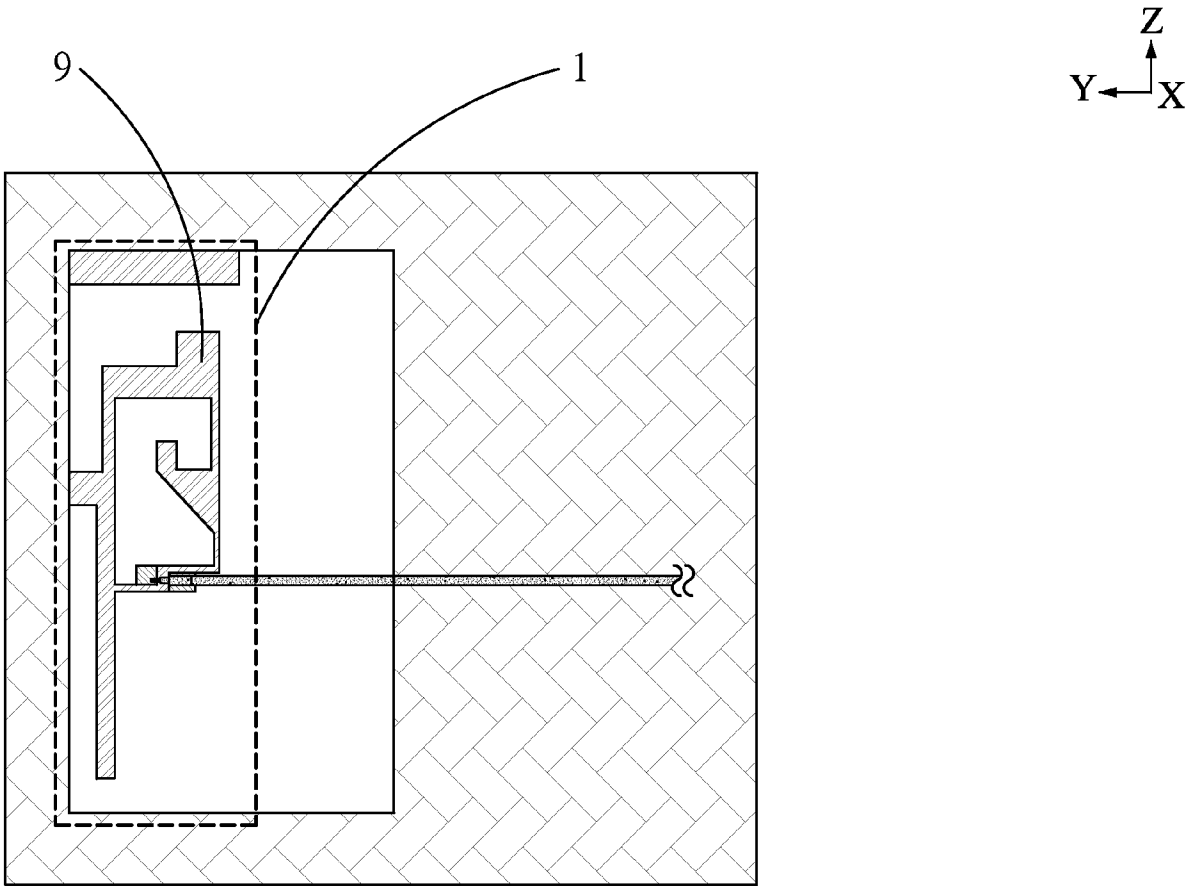
FIG. 2 is a schematic diagram showing an exemplary dual-band monopole coupling antenna formed on a printed circuitboard with independent ground.
Figure 3:
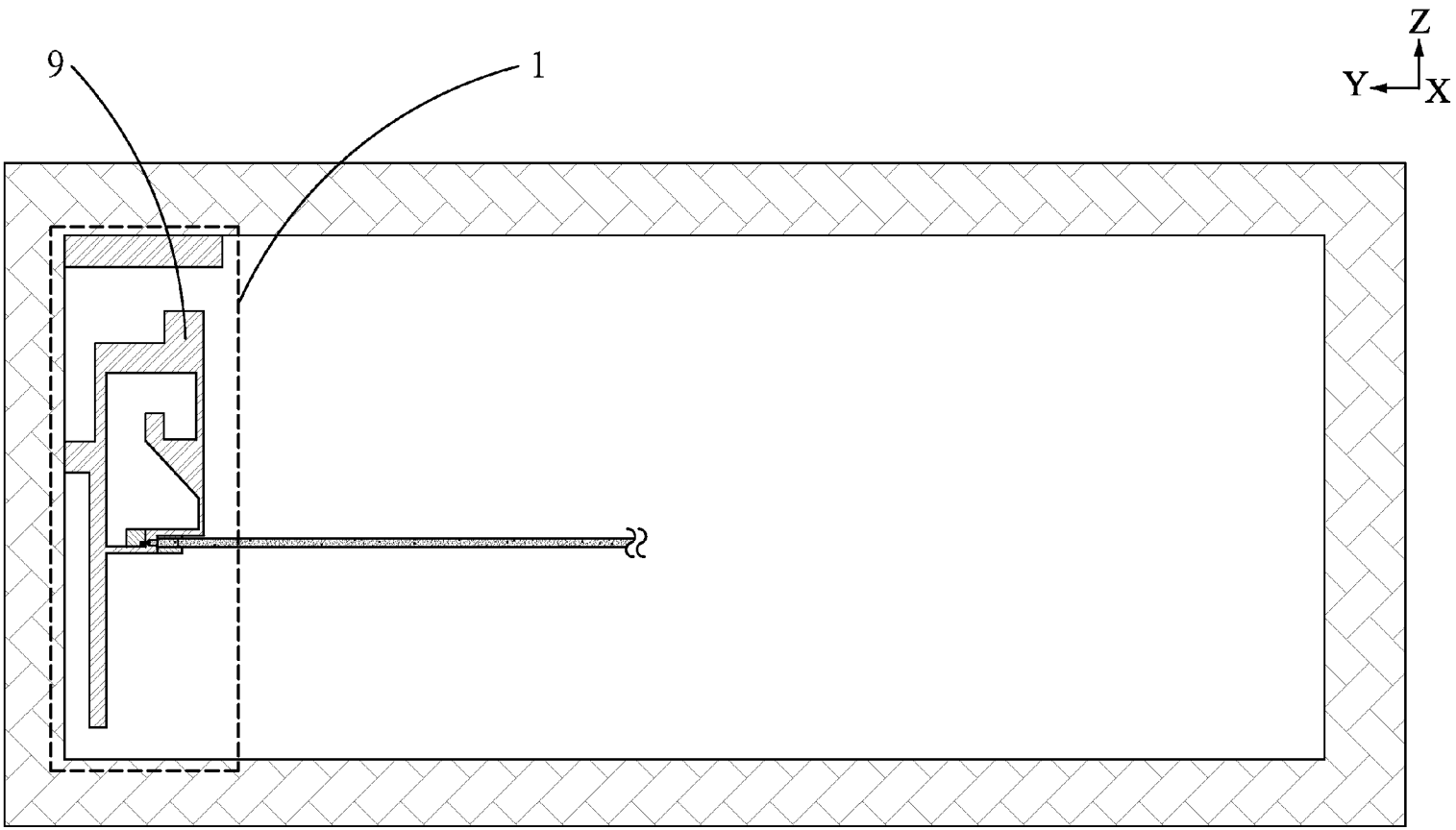
FIG. 3 is a schematic diagram showing an exemplary dual-band monopole coupling antenna formed on a printed circuitboard with non-independent ground.

Please refer to FIG. 2 and FIG. 3, which are respective a schematic diagram showing an exemplary dual-band monopole coupling antenna formed on a printed circuitboard with independent ground and a schematic diagram showing an exemplary dual-band monopole coupling antenna formed on a printed circuitboard with non-independent ground. Using different ground designs, the dual-band monopole coupling antenna of the invention can be a built-in antenna adapted for various wireless communication devices. The combined monopole with couple-type dual-band printed antenna suggested in the embodiments of the present invention is an antenna that can be adjusted and modified easily for meeting any specified requirement of different wireless communication devices. For instance, it can be adapted to operate in the following different frequency bands, including: LTE-Band 1 (1920~2170 MHz), LTE-Band 3 (1710~1880 MHz), LTE-Band 4 (1710~21455 MHz), 3G-Band (860~1000 MHz), LTE-Band 40 (2300~2400 MHz), LTE-Band 20 (791~862 MHz), UMTS (1920~2170 MHz), and thus the combined monopole with couple-type dual-band printed antenna of the present invention can be used in wireless communication devices operating in the aforesaid frequency bands, such as notebook computers, access points (APs), TV with Wi-Fi capability and DVD with Wi-Fi capability, and so on. In addition, the antenna suggested in the present invention can be used in all wireless communication devices of LTE 1805 MHz~2170 MHz, or can be used as frequency adjusting antenna for other wide-band radio communication devices.

Figure 4:
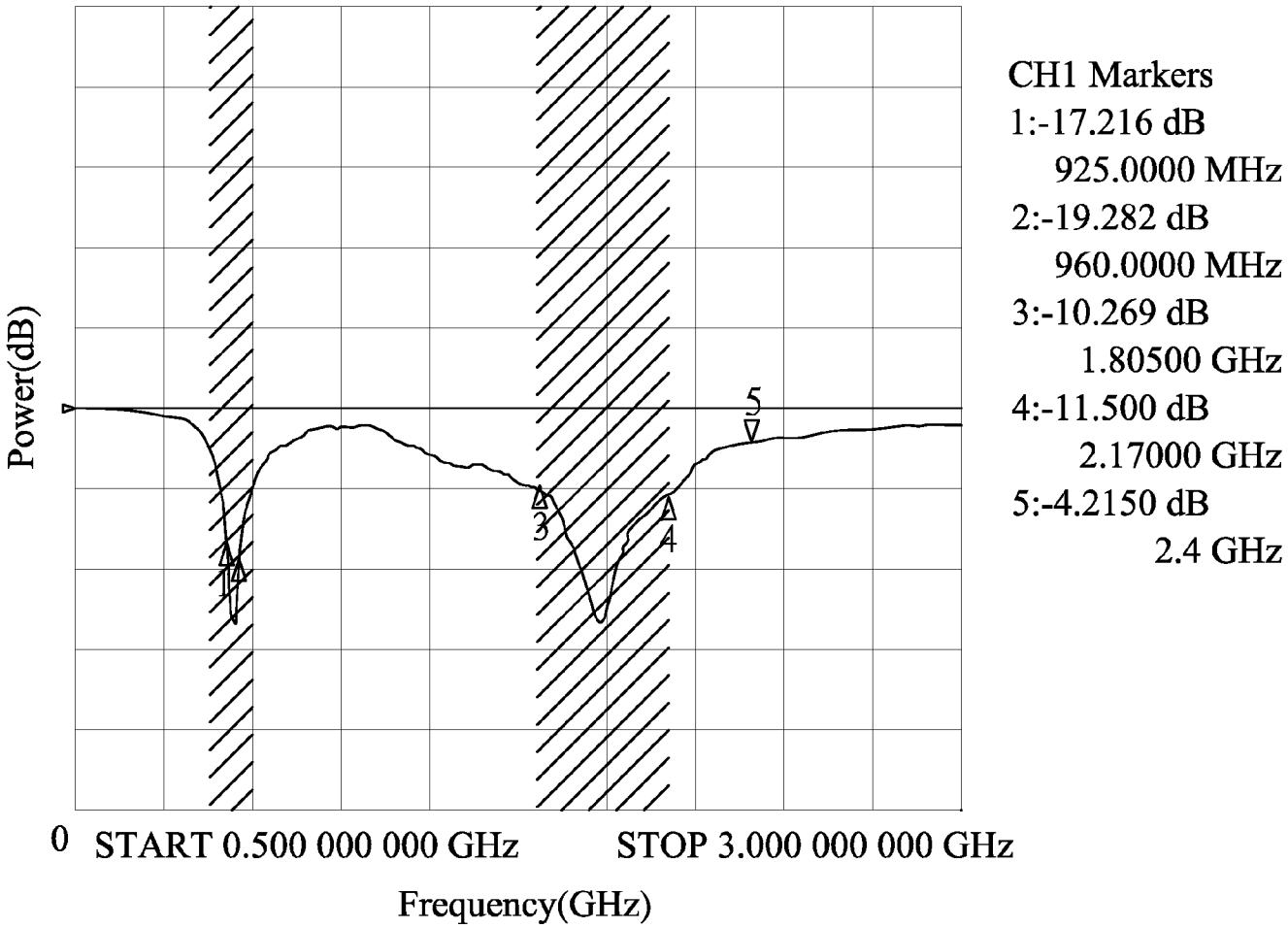
FIG. 4 shows the test result of return lose for a dual-band monopole coupling antenna of the present invention.

Please refer to FIG. 4, which shows the test result of return lose for a dual-band monopole coupling antenna of the present invention. In FIG. 4, the X axis represents the operation frequency, that is ranged between 500 MHz~3 GHz, while Y axis represents the transceiving power. As shown in FIG. 4, there are five samples marked in a simulated operation curve, in which sample 1 and sample 2 are working within the range of the first frequency, sample 3 and sample 4 are working within the range of the second frequency, while sample 5 is not within the working range of the designed transceiving frequency. That is, the frequency of the sample 1 is 925 MHz at a transceiving power of −17.216 dB; the frequency of the sample 2 is 960 MHz at a transceiving power of −19.282 dB; the frequency of the sample 3 is 1.805 GHz at a transceiving power of −10.269 dB; the frequency of the sample 4 is 2.17 GHz at a transceiving power of −11.5 dB; and the frequency of the sample 5 is 2.4 GHz at a transceiving power of −4.215 dB. According to the simulated operation curve and the five samples, the combined monopole with couple-type dual-band printed antenna of the present invention can work normally at the first frequency and the second frequency.

Figure 5:
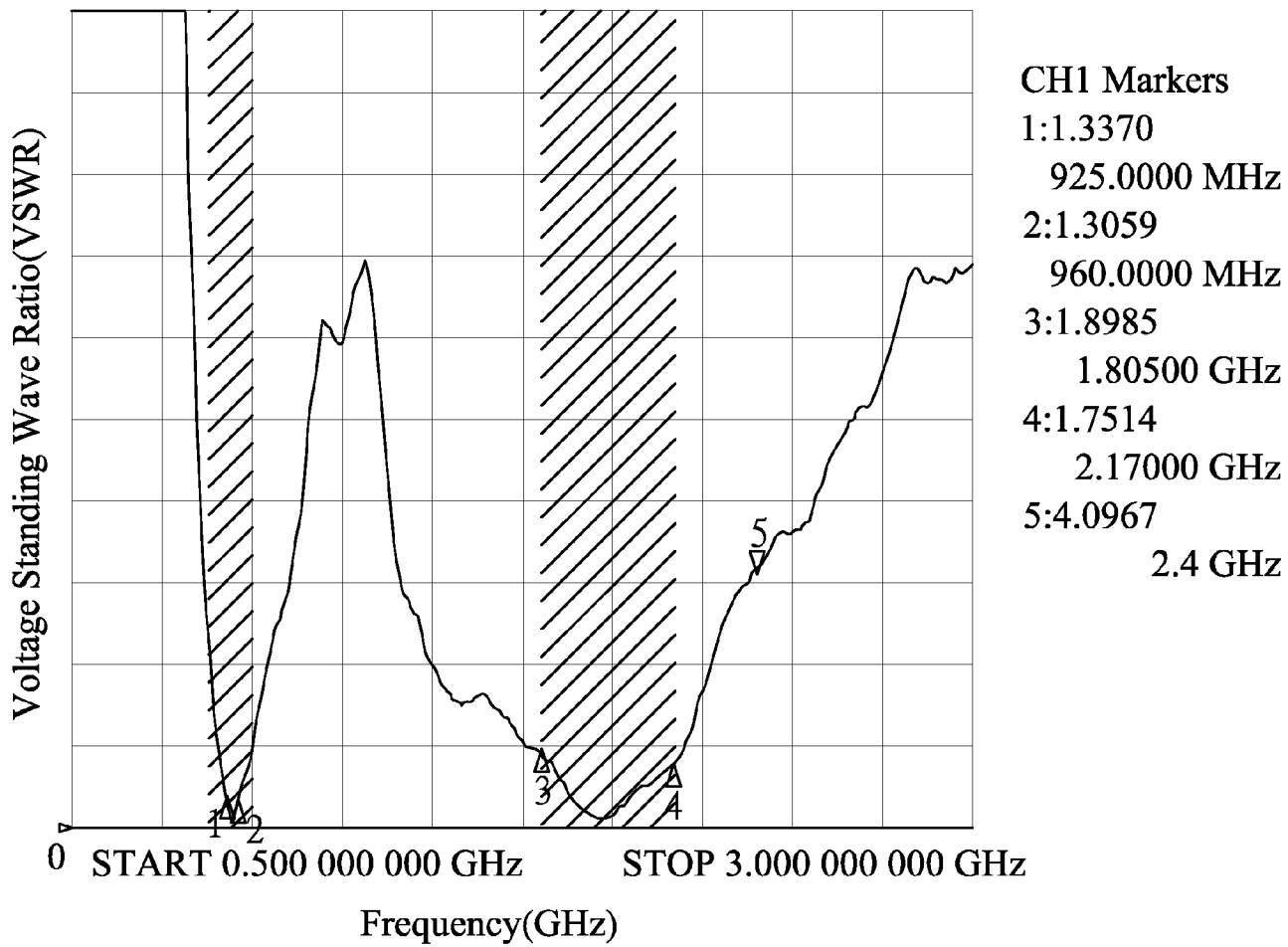
FIG. 5 shows the test result of VSWR for a dual-band monopole coupling antenna of the present invention.
Figure 6A:
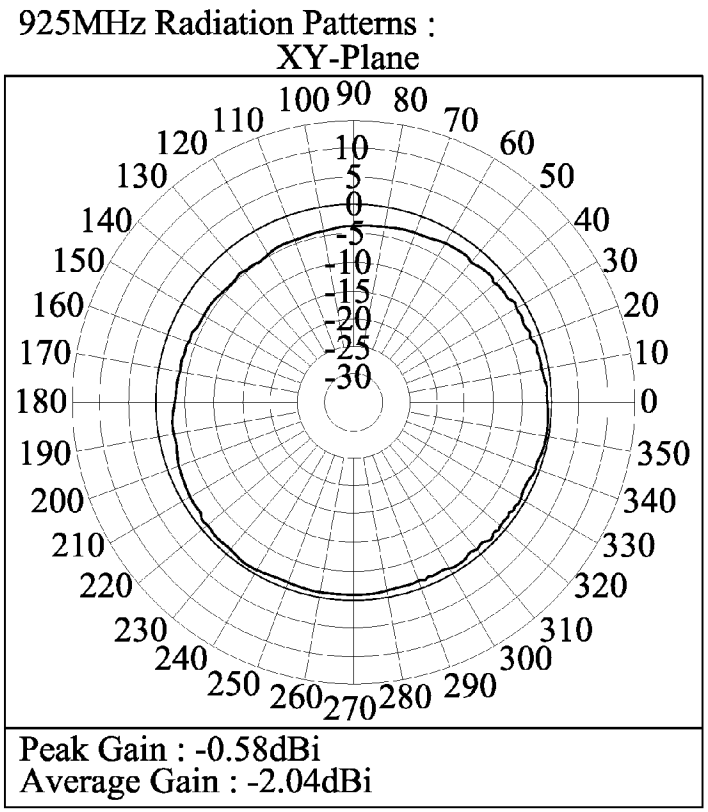
FIG. 6A~FIG. 6C are 925 MHz radiation patterns for a dual-band monopole coupling antenna of the present invention.
Figure 6B:
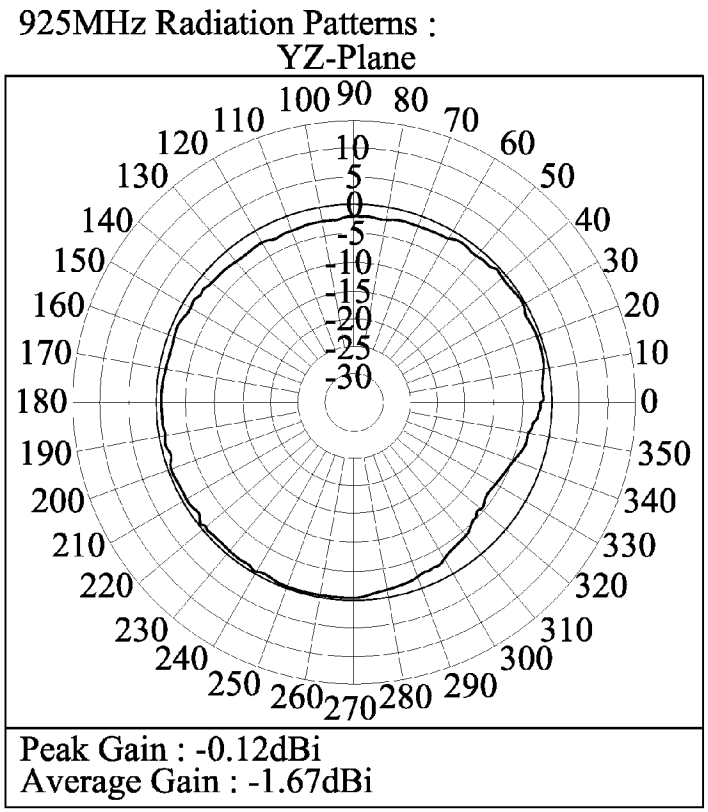
Figure 6C:
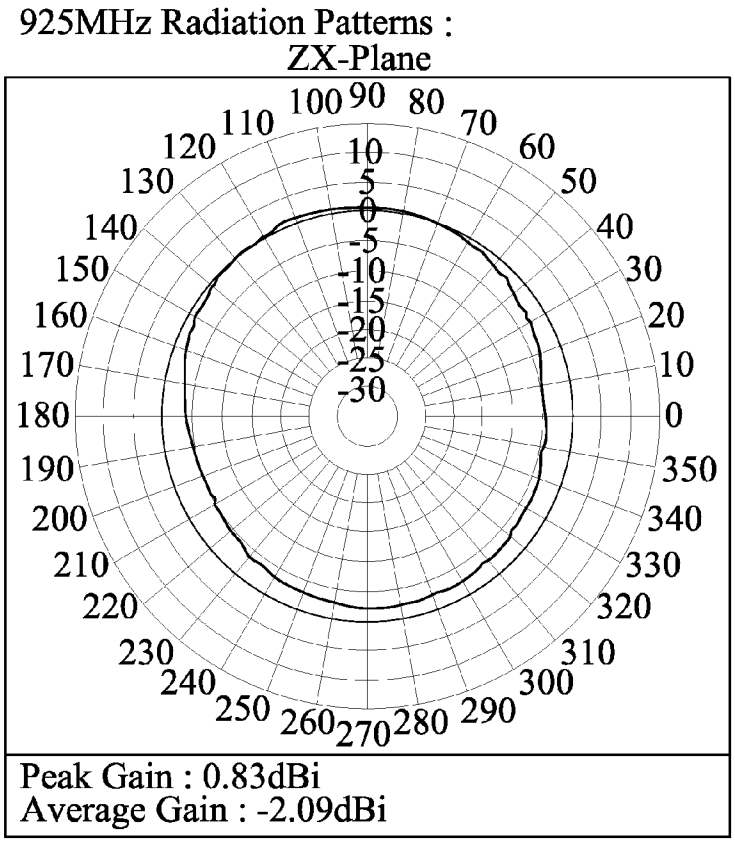
Figure 7A:
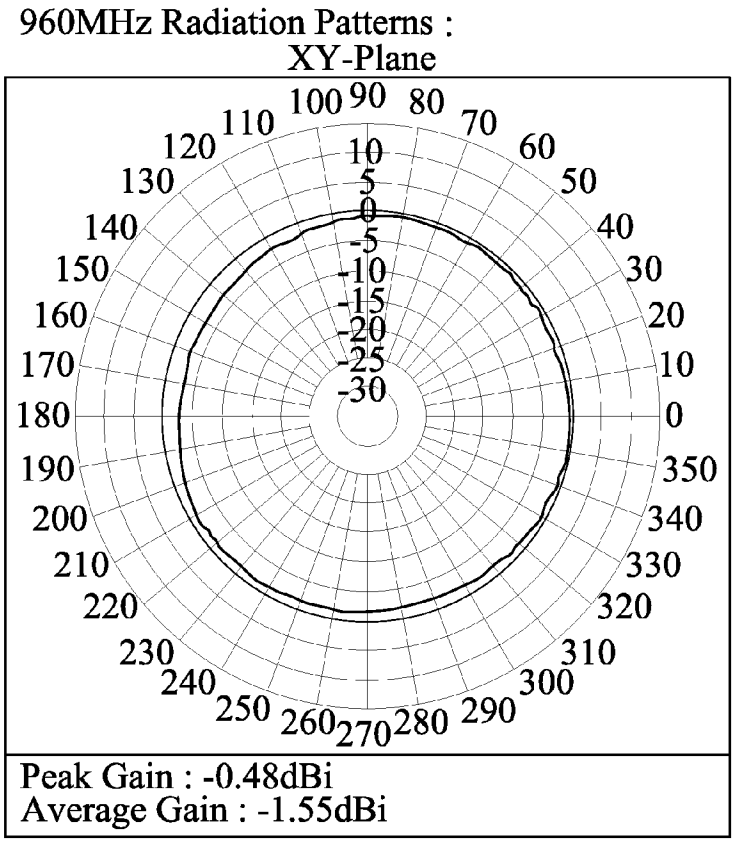
FIG. 7A~FIG. 7C are 960 MHz radiation patterns for a dual-band monopole coupling antenna of the present invention.
Figure 7B:
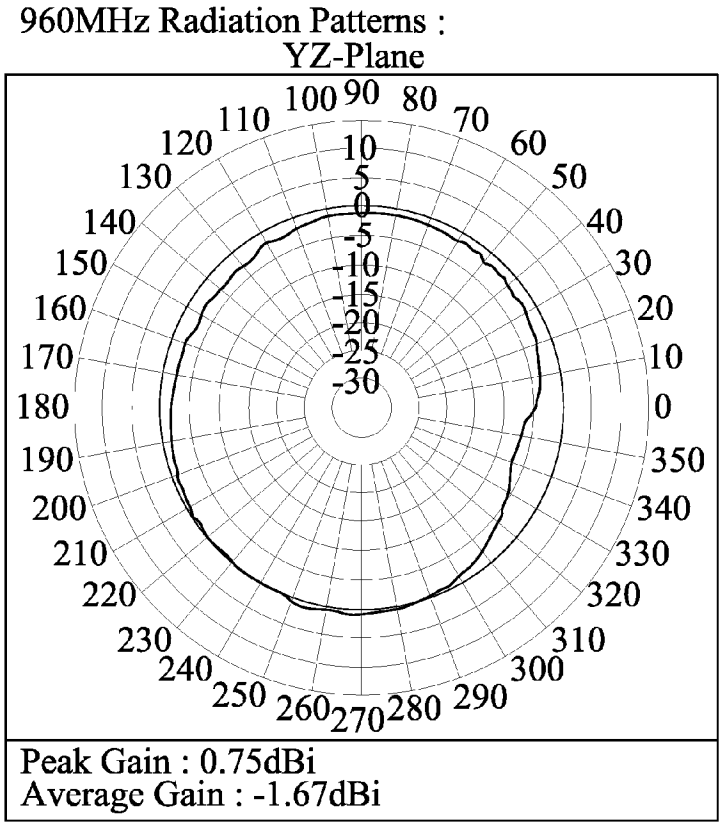
Figure 7C:
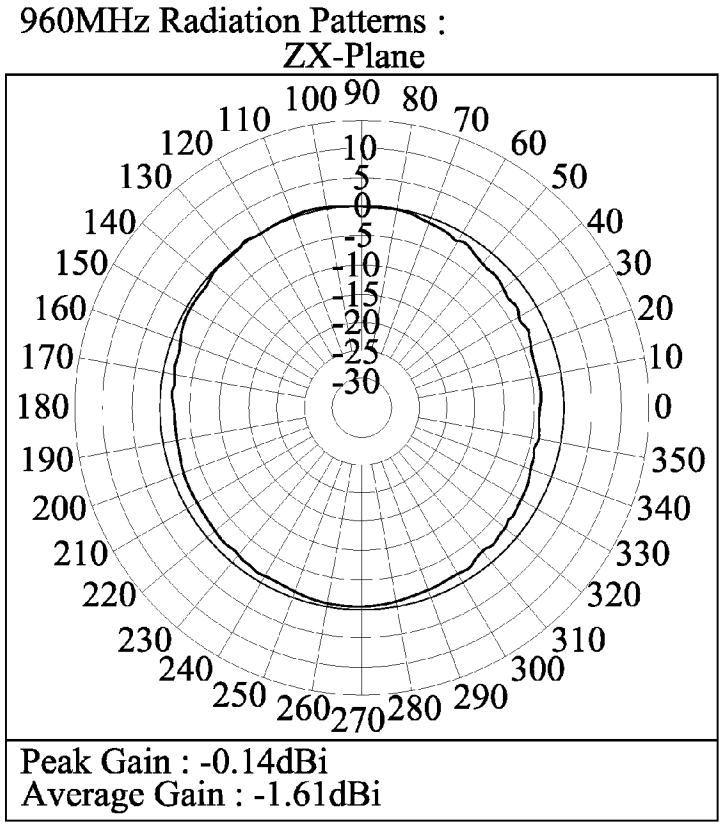
Figure 8A:
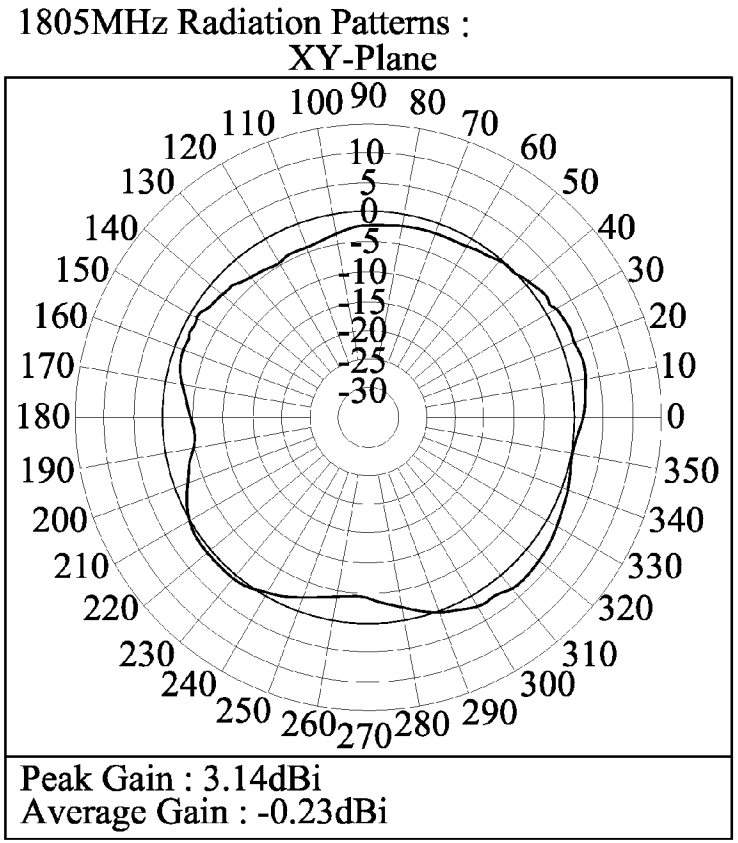
FIG. 8A~FIG. 8C are 1805 MHz radiation patterns for a dual-band monopole coupling antenna of the present invention.
Figure 8B:
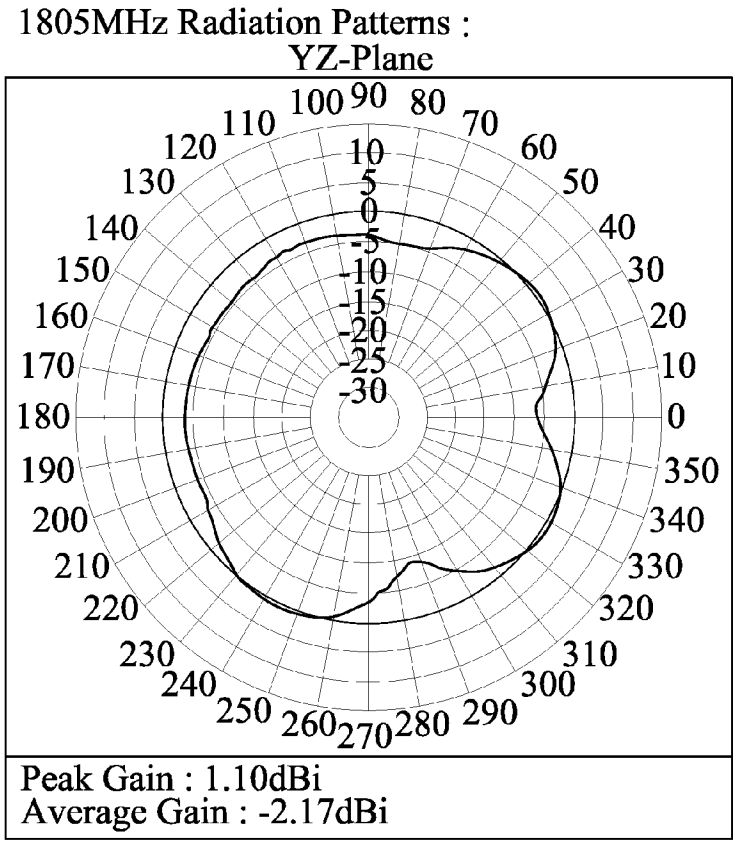
Figure 9A:
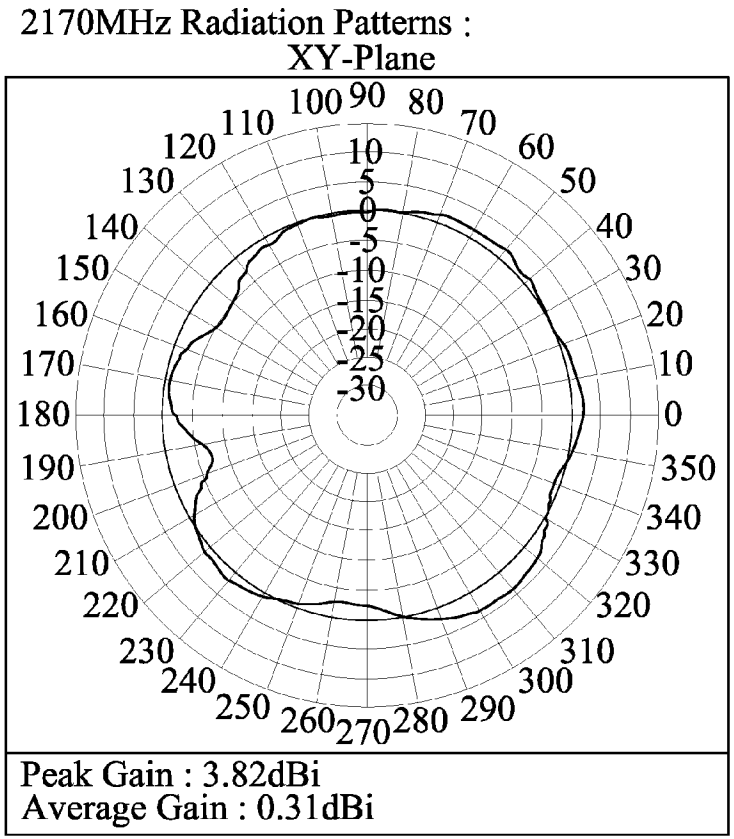
FIG. 9A~FIG. 9C are 2170 MHz radiation patterns for a dual-band monopole coupling antenna of the present invention.
Figure 8C:
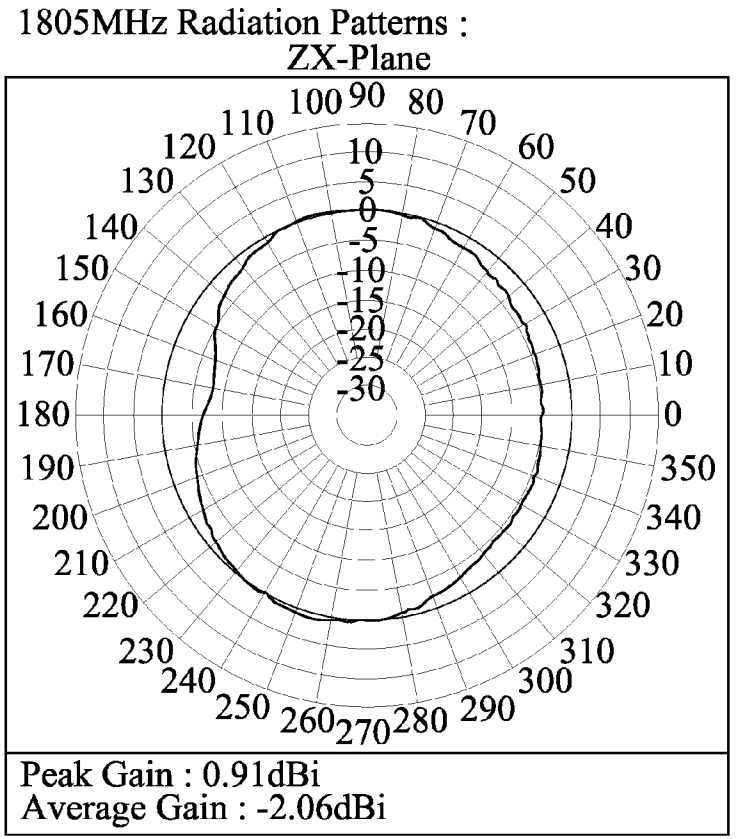
Figure 9B:
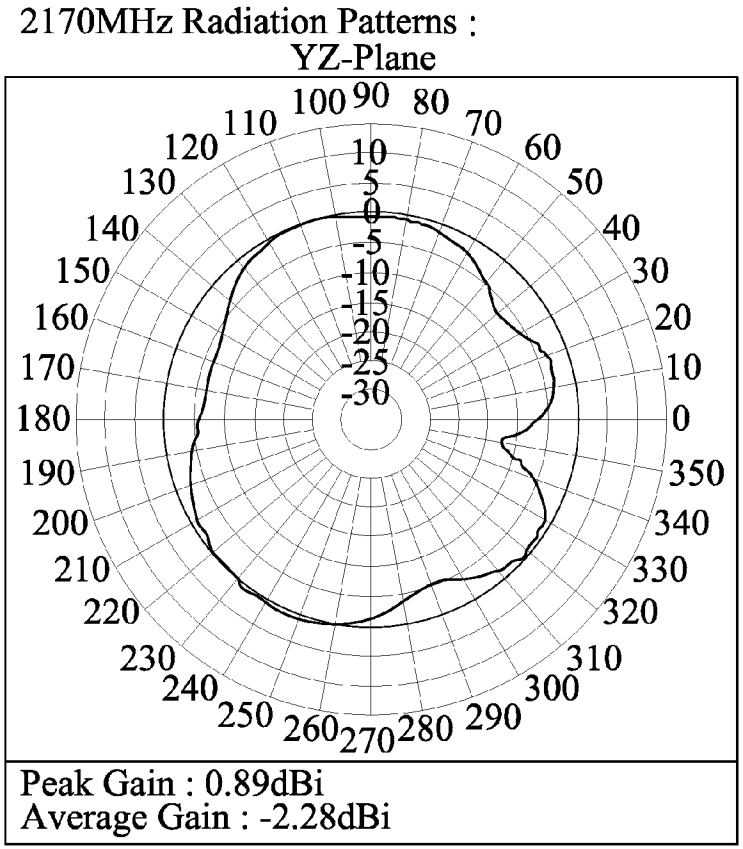
Figure 9C:
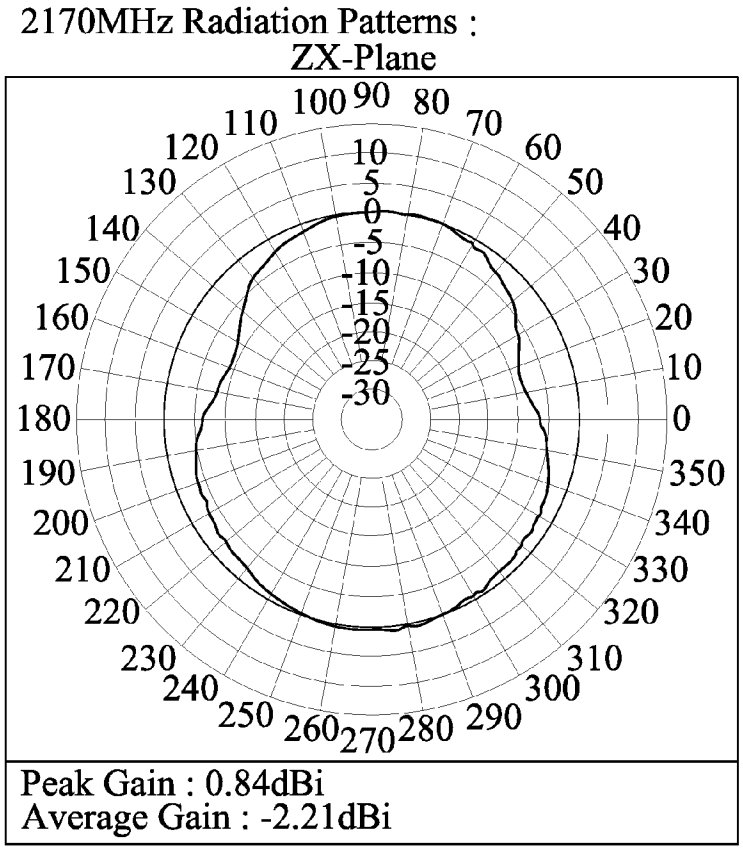

Please refer to FIG. 5, which shows the test result of VSWR for a dual-band monopole coupling antenna of the present invention. In FIG. 5, the X axis represents the operation frequency, that is ranged between 500 MHz~3 GHz, while Y axis represents the voltage standing wave ratio (VSWR). As shown in FIG. 5, there are five samples marked in a simulated operation curve, in which sample 1 and sample 2 are working within the range of the second frequency, sample 3 and sample 4 are working within the range of the first frequency, while sample 5 is not within the working range of the designed transceiving frequency. That is, the frequency of the sample 1 is 925 MHz with a VSWR of 1.337; the frequency of the sample 2 is 960 MHz with a VSWR of 1.3059; the frequency of the sample 3 is 1.805 GHz with a VSWR of 1.8985; the frequency of the sample 4 is 2.17 GHz with a VSWR of 1.7514; and the frequency of the sample 5 is 2.4 GHz with a VSWR of 4.0967. According to the simulated operation curve and the five samples, the combined monopole with couple-type dual-band printed antenna of the present invention can work normally at the first frequency and the second frequency.

FIG. 6A~FIG. 9C are radiation patterns for a dual-band monopole coupling antenna of the present invention. The radiation patterns are obtained based upon the relationship between VSWR and frequency for the samples 1~4 disclosed in FIG. 4 and FIG. 5. As shown in FIG. 6A~FIG. 9C, the peak gains and average gains conform to every specifications of dual-band antennas.

From the embodiments disclosed in FIG. 1 to FIG. 9C, it is concluded that the present invention provides a dual-band monopole coupling antenna, and more particularly, to provide a combined monopole with couple-type dual-band printed antenna that is designed with adjustable frequency band for adapting the same to operate under various working environments and also is substantially a printed antenna to be formed directly on a circuitboard for minimizing the molding cost as well as the production cost of three-dimensional antennas. Moreover, the combined monopole with couple-type dual-band printed antenna suggested in the present invention is an antenna that can be adjusted and modified easily for meeting any specified requirement of different wireless communication devices.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A dual-band monopole coupling antenna, comprising:

a first radiation part, being disposed on a surface of a substrate, the first radiation part comprising:

a frame and a primary extension, in which the frame is configured to have a free end and a connected end and formed as a hook shape comprised of rectangular extensions, wherein the frame is designed to be set at a certain length to set a desired operation frequency of the antenna; and the primary extension is formed as a rectangular section connected to a right trapezoid section having a tapered end connected to the connected end of the frame, wherein, the signal feed-in section is disposed at the rectangular section of the primary extension;

a second radiation part, disposed on the surface of the substrate at a position neighboring to the first radiation part, configured to capacitively couple with the first radiation part to extend the radiation of the first radiation part, wherein the lengths of the sections of the second radiation part are designed to be set to provide a desired overall operation frequency, impedance, and impedance matching of the dual-band monopole coupling antenna, the second radiation part comprising:

a first rectangular extension and a second L-shaped extension, wherein the first extension extends from a signal ground section in a first direction and is configured to have a length to operate at a second frequency, wherein the signal ground section is disposed at an end of the first extension that is disposed neighboring to the first radiation part; and the second extension is designed to be set at a certain length to set the second frequency and is configured to have two rectangular sections, such that one of the two sections connects to one end of the first extension and extends in a second direction orthogonal to the first direction, and the other section extends in a third direction opposite to the first direction, and thereby, the second radiation part, the first extension, and a portion of the second extension are disposed neighboring to the primary extension of the first radiation part; and a third rectangular extension and a fourth rectangular extension, wherein the third extension extends in the second direction; and the fourth extension is configured with two ends, so that one of the two ends is connected to the third extension and the other end extends in the first direction, and thereby, the second radiation part, the third extension, and a portion of the fourth extension are disposed neighboring to the frame of the first radiation part while the impedance matching of the antenna is designed to be set according to the gap formed between the second extension and the fourth extension; a signal ground section, disposed on the surface of the substrate while having an end thereof configured to connect to the second radiation part and another end thereof configured to connect to the signal feed-in line;

the signal feed-in section, disposed on the surface of the substrate at a position neighboring to the signal ground section while coupling to the first radiation part; a ground, disposed on the surface of the substrate while coupling to the second radiation part; and a dielectric layer, disposed at a non-conductive area;

wherein, the first radiation part is designed to operate at a first frequency, while the second radiation part is designed to operate at a second frequency;

wherein the second radiation part is disposed neighboring to the first radiation part by a neighboring side thereof, while the second radiation part extends in the first and third directions along the neighboring side, wherein the primary extension of the first radiation part extends in the first direction, and the frame of the first radiation part extends in the third direction; and wherein, a rectangular fifth extension is attached to a side of the third extension and a side of the fourth extension and neighboring to the frame of the first radiation part, and consequently, the size of the fifth extension is designed to be set to have the desired impedance matching of the antenna.

2. The dual-band monopole coupling antenna of claim 1, wherein the ground is a component selected from the group consisting of: an independent ground and a non-independent ground.

3. The dual-band monopole coupling antenna of claim 1, wherein the dielectric layer is disposed at an non-conductive area arranged surrounding the first radiation part and the second radiation part.

4. The dual-band monopole coupling antenna of claim 1, wherein the first frequency is higher than the second frequency.

5. The dual-band monopole coupling antenna of claim 1, further comprising:

a signal feed-in line, configured with a center signal line, a ground end, an isolation layer, a signal feed-in point in a manner that the center signal line is connected to the signal feed-in section and the ground end is connected to the signal ground section.

* * * * *